United States Patent [19]

Giese et al.

[11] 4,005,532

[45] Feb. 1, 1977

[54] INSULATED INSOLE CONSTRUCTION

[75] Inventors: Erik O. Giese, Key Biscayne, Fla.; Alexander Louis Gross, Aspen, Colo.

[73] Assignee: Comfort Products, Inc., Aspen, Colo.

[22] Filed: Aug. 20, 1975

[21] Appl. No.: 606,223

[52] U.S. Cl. ..... 36/44

[51] Int. Cl.[2] ..... A43B 13/38

[58] Field of Search ..... 36/43, 44, 30 R, 30 A, 36/25 A, 28, 29

[56] References Cited

UNITED STATES PATENTS

| | | | |
|---|---|---|---|
| 1,111,361 | 9/1914 | Carr | 36/43 |
| 2,644,250 | 7/1953 | Ciaio | 36/44 |
| 2,766,158 | 10/1956 | Rinecker | 36/44 |
| 3,530,489 | 9/1970 | Appleton | 36/44 |

*Primary Examiner*—Patrick D. Lawson
*Attorney, Agent, or Firm*—Pennie & Edmonds

[57] ABSTRACT

An insulated insole construction comprising a layer of plastic mesh material shaped such that when inserted in a shoe, it will have a portion extending over the inner sole of the shoe. A portion of the insole may be bent to form a toe cap to encircle the inner toe area of the shoe and the insole may have an additional portion engaging the inner sides of the shoe in the heel and arch area. The plastic mesh material comprises two spaced mesh-like plastic fabrics separated by a plastic separating material, all of which are encased within plastic films to form a non-collapsible chamber between the plastic films.

4 Claims, 3 Drawing Figures

INSULATED INSOLE CONSTRUCTION

BACKGROUND OF THE INVENTION

Conventional insoles used in shoes for insulation purposes extend only over the sole portion of the shoe. The result is that the side areas of the shoe, and particularly those areas near the seam joining the sole of the shoe with the body of the shoe, are not insulated. These particular areas tend to retain snow, ice and moisture, all of which will increase heat loss from the foot of the wearer unless proper insulation is provided. Further, conventional insole constructions have comprised cloth or elastomeric material which do not have particularly high insulation properties. It is therefore an object of our invention to provide for an insulated insole construction having high insulation properties to protect the wearer against excessive cold or heat. It is a further object of our invention to provide for an insole construction which will extend over the sole of the shoe and which will provide insulation for those areas of the foot most sensitive to cold, namely the toes. It is a still further object to provide for insulation in the area along the seam where the sole joins with the shoe body.

GENERAL DESCRIPTION OF THE INVENTION

Broadly our invention comprises having a layer of plastic mesh material made up of an insole portion which will conform to the inner sole of a shoe and which may be included in the shoe during the construction of the shoe or inserted separately into a completed shoe. A toe rim portion may extend beyond the insole portion where it is adapted to be bent up and back to form a toe cap such that the toe cap will engage the inner toe area of the shoe to provide insulation to the top of the toes of the wearer as well as the bottom. A rim portion of plastic mesh material may extend beyond the insole portion in the heel and arch area where it is to be bent upwardly to engage the inner sides of the shoe along the seam area where the sole of the shoe engages the shoe bottom.

The plastic mesh material comprises two mesh-like plastic fabrics which are separated by a plastic separating material which may take the form of a monofilament. The separating material is of such strength as to prevent deformation of the mesh-like fabrics towards each other when subjected to the weight of the wearer of the shoe. The mesh-like fabrics are enclosed on both sides by thin films of plastic which are sealed around their edges by heating or dielectric means such that the spacing between the two mesh-like fabrics becomes a hermetically sealed chamber. In one form of the invention, air may be left within the chamber, while in other forms of the invention, air may be evacuated from the chamber or replaced by a pressurized gas having a lower co-efficient of heat transfer than air.

DETAILED DESCRIPTION OF THE PREFERRED EMBODIMENTS

Figure 1:
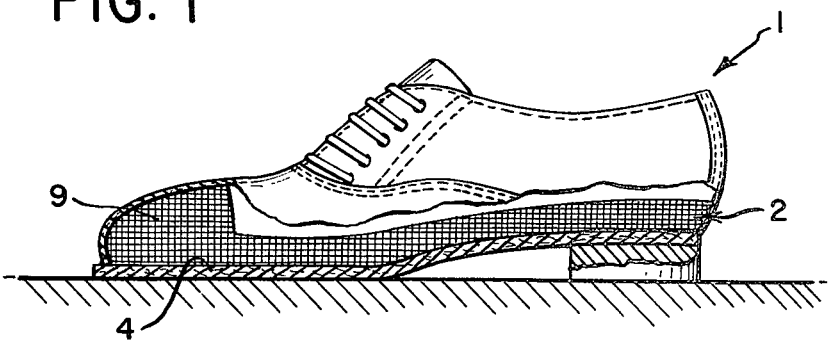
FIG. 1 is a partial side section of a shoe equipped with an insulated insole construction according to the invention.

Referring to FIG. 1 there is illustrated a shoe 1 having an insole 2 constructed according to the invention inserted therein. While a normal walking shoe is illustrated, it is to be understood that the insole construction of the invention is applicable for insertion in hiking boots, working boots, ski boots and the like.

Figure 2:
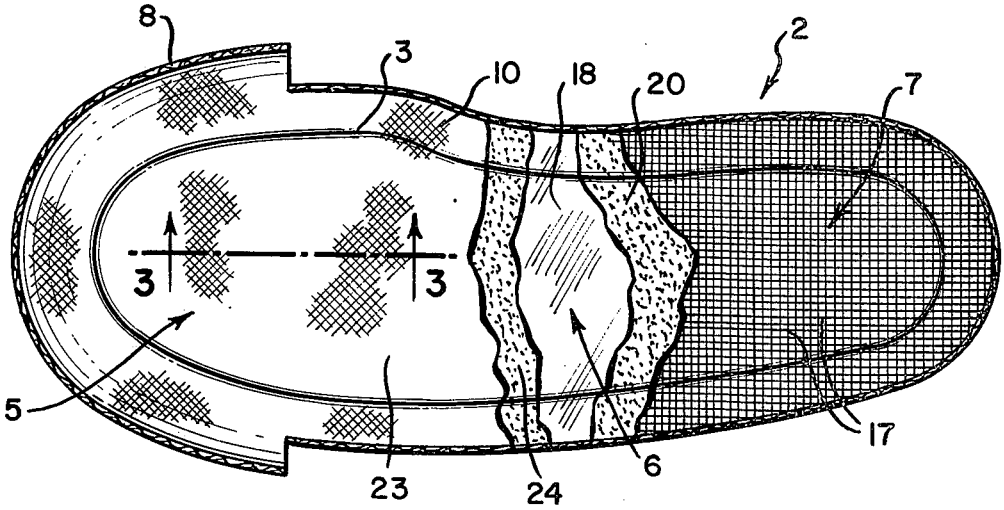
FIG. 2 is a plan view of an insole construction according to the invention before being installed in a shoe.

As shown in FIG. 2, the insole construction 2 comprises an insole portion 3 which conforms in shape to the inner sole of the shoe to which it is to be fitted, for example the inner sole 4 of the shoe depicted in FIG. 1. The insole portion 3 comprises a toe portion 5, arch portion 6 and a heel portion 7. The toe portion 5 may have a toe rim portion 8 which is adapted to be bent upwardly along the outline of the insole 3 to form a toe cap 9 such as is shown in FIG. 1 which completely encircles the inner toe area of the shoe to provide insulation to the top of the toes of the wearer as well as the bottom and sides.

The insole 3 may be further provided with a side rim portion 10 in the arch and heel areas such that when the insole is inserted in the shoe of FIG. 1, the side rim portions will be bent upwards to engage the inner sides of the shoe.

This particular construction of the insole to form the toe cap 9 and the upstanding portions engaging the inner sides of the shoe in the heel and arch area provides insulation where most needed, namely the toe area to protect the toes of the wearer which are the portions of the foot most sensitive to cold and the area of the shoe near the seam joining the sole with the shoe body which tends to collect moisture.

Figure 3:
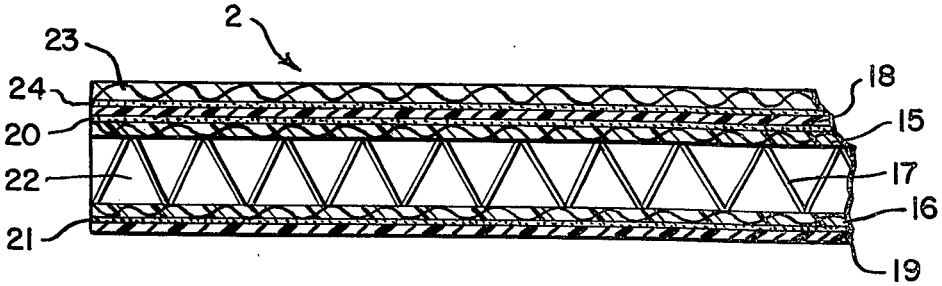
FIG. 3 is an enlarged section of the insole construction of FIG. 2 taken along lines 3–3.

The plastic mesh material making up the body of the insole construction is depicted in FIG. 3 and comprises a first mesh-like plastic fabric 15 which is spaced from a mesh-like second fabric 16 by means of a plastic separating material 17. The particular plastic comprising the fabrics 15 and 16 as well as the separating material 17 is of a saran or polyethylene type. The separating material 17 may comprise a corrugated monofilament which is of such sufficient strength to prevent excessive movement of the fabrics 15 and 16 towards each other when subjected to the weight of the wearer.

Fabrics 15 and 16 are encased by plastic films 18 and 19 and may be joined to the fabrics by means of adhesive layers 20 and 21. The plastic films may comprise an acrylic material which has heat sealable or dielectric sealable properties. The films are sealed together around the periphery of the insole construction in order to form a non-collapsible hermetically sealed chamber 22 therebetween, the non-collapsible feature being provided by the corrugating separating material 17. The dead air entrapped within the chamber provides insulation preventing excess loss of heat from the foot of the wearer.

The insulation properties of the insole construction may be further increased by evacuating air from the chamber 22 so as to have a vacuum chamber or in a still further form of the invention, the chamber 22 may be pressurized with a gas having a lower co-efficient of heat transfer than air, for example carbon dioxide.

An anti-slip layer of fabric 23, for example a nylon tricot, may be applied to the film 18 by a layer of adhesive 24. The fabric 23 prevents slipping of the foot of the wearer relative to the insole. The fabric 23 is shaped to conform with the insole portion 6.

The insole construction according to the invention may, when inserted in a ski boot construction, be applied between the boot body and the conventional inner liner of the boot or in the inner liner itself.

We claim:

1. An insulated insole construction having a toe, arch and heel area adapted to be included in a shoe comprising, a layer of plastic mesh material shaped to include an insole portion conforming to the inner sole of a shoe where the plastic mesh material comprises a mesh-like plastic first fabric, a mesh-like plastic second fabric spaced from said first fabric, a corrugated plastic separating material extending between and joining said first and second fabrics, a first plastic film overlying said first fabric and a second plastic film overlying said second fabric with said first and second plastic films being sealed together around their edges to hermetically encase said first and second fabrics and separating material to form a noncollapsible insulating chamber therebetween.

2. An insulated insole construction according to claim 1 wherein said chamber is depressurized to form a vacuum chamber.

3. An insulated insole construction according to claim 1 wherein said chamber is pressurized with a gas having a lower co-efficient of heat transfer than air.

4. An insulated insole construction having a toe, arch and heel area adapted to be included in a shoe comprising, a layer of plastic mesh material shaped to include an insole portion conforming to the inner sole of a shoe where the plastic mesh material has in addition a toe rim portion extending beyond the insole portion in the toe area whereby when said insole construction is included in a shoe, said toe rim portion is turned up and over to form a toe cap which encircles the inner toe area of a shoe.

* * * * *